United States Patent [19]

Smith, Jr.

[11] Patent Number: 4,908,146

[45] Date of Patent: Mar. 13, 1990

[54] OIL ADDITIVE COMPOSITIONS EXHIBITING REDUCED HAZE CONTAINING POLYMERIC VISCOSITY INDEX IMPROVER

[75] Inventor: Marvin F. Smith, Jr., Aberdeen, N.J.

[73] Assignee: Exxon Chemical Patents Inc., Linden, N.J.

[21] Appl. No.: 271,698

[22] Filed: Nov. 16, 1988

[51] Int. Cl.[4] ..... C10M 161/00

[52] U.S. Cl. ..... 252/56 R; 585/12

[58] Field of Search ..... 252/56 R; 585/12

[56] References Cited

U.S. PATENT DOCUMENTS

| | | | |
|---|---|---|---|
| 4,069,162 | 1/1978 | Gardiner et al. | 585/12 |
| 4,137,185 | 1/1979 | Gardiner et al. | 252/33 |
| 4,146,492 | 3/1979 | Cusano et al. | 252/56 R |
| 4,507,515 | 3/1985 | Johnston et al. | 585/12 |
| 4,517,104 | 5/1985 | Bloch et al. | 252/51.5 |
| 4,620,048 | 10/1986 | Ver Strate et al. | 585/12 |
| 4,707,285 | 11/1987 | Brewster et al. | 252/56 R |
| 4,803,003 | 2/1989 | Chung | 252/51.5 |
| 4,804,794 | 2/1989 | Ver Strate et al. | 585/12 |

*Primary Examiner*—Jacqueline V. Howard

*Attorney, Agent, or Firm*—M. B. Kapustij

[57] ABSTRACT

Oil compositions comprising a lubricating oil and oil-soluble hydrocarbon polymeric viscosity index improvers such as ethylene-propylene copolymers are substantially haze-free when said compositions contain an anti-hazing effective amount of a hydrocarbyl substituted succinic acid. The invention also relates to the process for preparing said compositions.

39 Claims, No Drawings

OIL ADDITIVE COMPOSITIONS EXHIBITING REDUCED HAZE CONTAINING POLYMERIC VISCOSITY INDEX IMPROVER

BACKGROUND OF THE INVENTION

1. Field of the Invention

This invention relates to viscosity index improver containing oil compositions, particularly lubricating oil compositions, exhibiting reduced haze, and to a process for preparing such compositions. In particular, this invention is directed to low-haze or substantially haze-free lubricating oil compositions and additive packages used in their formulation containing hydrocarbon polymer viscosity index improvers and a haze-reducing effective amount of an oil-soluble hydrocarbyl substituted succinic acid.

2. Description of the Prior Art

An important property of a lubricating composition is the rate at which its viscosity changes as a function of temperature. The relationship between the viscosity and temperature is commonly expressed as the viscosity index (V.I.) Lubricant compositions which change little in viscosity with variations in temperature have a greater viscosity index than do compositions whose viscosity is materially affected by changes in temperature. One of the major requirements of the lubricating oils is a satisfactory viscosity-temperature characteristic so that the oils will not lose their fluidity but will show an equally good performance within a relatively wide temperature range to which they may be exposed in service.

In addition to refining natural petroleum oils to improve their viscosity index characteristics, it has been common practice to introduce long chain hydrocarbon compounds such as linear polymers in order to raise the viscosity index of lubricant compositions. Among the V.I. improvers that have been described in the patent literature are polyisobutylenes as taught in U.S. Pat. Nos. 2,084,501 and 2,779,753; polyalkylmethacrylates as described in U.S. Pat. No. 3,607,749; copolymers of alkylmethacrylates and styrene as shown in U.S. Pat. No. 3,775,329; hydrogenated butadienestyrene copolymers as shown in U.S. Pat. No. 2,798,853; and copolymers of butadiene, styrene and isoprene as shown in U.S. Pat. No. 3,795,615.

It is known to utilize ethylene-alpha-olefin copolymers such as ethylene-propylene copolymers as viscosity index improvers. Thus, lubricants containing copolymers of ethylene and propylene having from 60 to 80 mole % of ethylene and viscosity-average molecular weight in the range of 10,000 to 200,000 have been described in U.S. Pat. No. 3,551,336. U.S. Pat. No. 3,522,180 describes a lubricating oil composition containing a viscosity index improver comprising an ethylene-propylene copolymer having an amorphous structure with a number average molecular weight ($\overline{M}_n$) of between 10,000 and 40,000, a propylene content of 20 to 70 mole %, and a $M_w/M_n$ of less than about 5 which is said to provide a substantially shear stable blend with improved viscosity index. U.S. Pat. No. 3,598,738 describes a mineral oil composition containing a viscosity index improver of a class of oil-soluble substantially linear ethylene hydrocarbon copolymers containing 25 to 55 wt. % polymerized ethylene units and from about 75 to 45% of a comonomer selected from the group consisting of unsaturated straight chain monoolefins of 3 to 12 carbon atoms, Ω-phenyl-alkenes of 9 to 10 carbon atoms, norbornenes and unsaturated non-conjugated diolefins of 5 to 8 carbon atoms which results in systems of outstanding shear stability; and British Patent No. 1,205,243 describes the preparation of ethylene-propylene copolymers, obtained by direct synthesis, having a measurable degree of side chain branching and ($\overline{M}_n$) of between 40,000 and 136,000.

The patent literature also discusses the mechanical agitation, churning or other mechanical disruption or degradation of polymeric materials, e.g., U.S. Pat. Nos. 2,727,693; 2,776,274; 2,858,299; and 3,503,948. The degradation of the molecular weight of ethylene-propylene copolymers has become useful in order to make various grades of polymers having different molecular weights and different thickening efficiencies in the lubricating oil. Such a degraded olefin polymer has been found to be useful when the precursor higher molecular weight ethylene-propylene copolymer has an ethylene content in the range of 40 to 85%, a degree of crystallinity of from about 1 to 25 wt. %, and a number average molecular weight ($\overline{M}_n$) of from 20,000 to 200,000 as taught by U.K. Patent No. 1,397,994.

It is often found during the preparation, processing, and/or storage of these various oil soluble hydrocarbon polymers that a haze develops in their oil concentrates or oil compositions (e.g., final oil formulations containing the hydrocarbon polymers or their concentrates). The source of this haze does not appear to be the same as that haze resulting from incompatibility of the several additives in a lubricating oil additive concentrate or composition (see U.S. Pat. No. 3,897,353 wherein haze resulting from component incompatibility is overcome in a lubricating oil additive concentrate by blending an amorphous ethylene-propylene copolymer with an n-alkyl methacrylate containing polymer having a number average molecular weight between about 30,000 and about 120,000). Rather, it is believed that this haze is due to the presence of a wide variety of catalysts, metal weak acid salts, etc. which are used in or result from the by-product of the polymerization, finishing process, or other steps in the manufacture or finishing of ethylene-containing copolymers or their oil concentrates. Thus, for example, a typical haze producing substance is calcium stearate having a particle size of from about 0.01 microns to about 15 microns, which calcium stearate is used in the finishing process of ethylene-propylene copolymers useful as V.I. improvers. Generally, oil compositions such as oil concentrates containing the ethylene copolymer viscosity index improver also contain a haze forming amount of these metal weak acid salts. These haze forming amounts are generally less than about 1 wt. % based on the total weight of the oil compositions.

This haze problem was addressed in U.S. Pat. 4,069,162 wherein it is disclosed that haze-free oil compositions containing an oil-soluble hydrocarbon polymeric viscosity index improver such as ethylene-propylene copolymer can be provided by adding to or treating said oil compositions with oil-soluble strong acid containing a hydrogen dissociating moiety which has a pK of less than about 2.5.

It has now been surprisingly discovered that the haze of oil compositions containing a hydrocarbon polymer viscosity index improver can be reduced or substantially eliminated by the addition thereto or treatment thereof with a hydrocarbyl substituted succinic acid, a weak acid containing two hydrogen dissociating moieties both of which have pKs above 2.5 (e.g., succinic acid has a $pK_1$ of 4.16 and a $pK_2$ of 5.61).

SUMMARY OF THE INVENTION

It has been discovered that the haze in lubricating oil compositions containing hydrocarbon polymeric V.I. improvers such as ethylene-propylene copolymers can be reduced or substantially eliminated by treating the hydrocarbon polymer or its oil composition, which typically comprises an oil such as lubricating oil and from 0.01 to 50, preferably 5 to 30 wt. % based upon said composition, of a soluble hydrocarbon polymeric material having viscosity index improving characteristics, with a hydrocarbyl substituted succinic acid. The present invention has particular utility when the hazing substance is a metal salt of a weak acid, said weak acid having a pK of more than about 3.8, preferably a pK of 4.0 to about 8 and said hazing substance has a particle size of from about 0.01 microns to about 15 microns. It is preferred to treat the oil composition containing the hazing substance which is derived from the dissociable metal-containing material, i.e. the weak acid, by introducing the oil-soluble hydrocarbyl substituted succinic acid within the range of from about 0.02 to about 0.5 weight percent, based on the weight of the oil composition.

DETAILED DESCRIPTION OF THE INVENTION

In accordance with the instant invention it has been discovered that the haze of an oil composition, such as a lubricating oil composition, containing a hydrocarbon polymer viscosity index improver, such as an ethylene-alpha-olefin copolymer, can be reduced or substantially eliminated by treating said composition with a haze reducing effective amount of a hydrocarbyl substituted succinic acid.

In a preferred embodiment of the instant invention haze is reduced substantially eliminated in a lubricating oil concentrate composition suitable for use in a lubricating oil composition comprising a lubricating oil and from about 0.01 to about 50 wt. % based on the weight of said concentrate composition of a hydrocarbon polymer viscosity index improver, preferably an ethylene-alpha-olefin copolymer (e.g., ethylene-propylene copolymer) having a number average molecular weight ($\overline{M}_n$) of from about 10,000 to 500,000, and a haze forming amount, e.g. less than about 1 wt. % based on the weight of said composition, of a hazing substance containing calcium stearate of particle diameter ranging from about 0.01 microns to about 15 microns by the step of treating said composition with a haze reducing effective amount of hydrocarbyl substituted succinic acid.

VISCOSITY INDEX IMPROVING POLYMERS

As earlier indicated, oil soluble hydrocarbon polymeric viscosity index improver oil compositions are contemplated to be processed in accordance with this invention whereby said compositions are reduced in haze or are substantially haze free. These V.I. improving polymers are hydrocarbon polymers having a number average molecular weight ($\overline{M}_n$) of from about 10,000 to about 500,000 preferably 10,000 to 200,000 and optimally from about 20,000 to 100,000. In general, hydrocarbon polymers having a narrow range of molecular weight, as determined by the ratio of weight average molecular weight ($\overline{M}_w$) to number average molecular weight ($\overline{M}_n$) are preferred. Polymers having a ($\overline{M}_w/\overline{M}_n$ of less than 10, preferably less than 7, and most preferably 4 or less are most desirable. As used herein ($\overline{M}_n$) and ($\overline{M}_w$) are measured by the well known techniques of vapor pressure (VPO) and membrane osmometry and gel permeation chromotography, respectively. These hydrocarbon polymers are prepared from ethylenically unsaturated hydrocarbons including cyclic, alicyclic and acyclic containing from 2 to 30 carbons.

Most commonly used are oil-soluble polymers of isobutylene. Such polyisobutylenes are readily obtained in a known manner as by following the procedure of U.S. Pat. No. 2,084,501, incorporated herein by reference, wherein the isoolefin, e.g. isobutylene, is polymerized in the presence of a suitable Friedel-Crafts catalyst, e.g. boron fluoride, aluminum chloride, etc. at temperatures substantially below 0° C. such as at −40° C. Such polyisobutylenes can also be polymerized with a higher straight chained alpha olefin of 6 to 20 carbon atoms as taught in U.S. Pat. No. 2,534,095, incorporated herein by reference, where said copolymer contains from about 75 to about 99% by volume of isobutylene and about 1 to about 25% by volume of a higher normal alpha olefin of 6 to 20 carbon atoms.

Other polymeric viscosity index modifier systems used in accordance with this invention are: copolymers of ethylene and $C_3$–$C_{18}$ monoolefins, such as copolymers of ethylene and propylene, as described in Canadian Patent No. 937,743; copolymers of ethylene, $C_3$–$C_{12}$ mono-olefins and $C_5$–$C_8$ diolefins as described in U.S. Pat. No. 3,598,738; mechanically degraded copolymers of ethylene, propylene and if desired a small amount, e.g. 0.5 to 12 wt. % of other $C_4$ to $C_{12}$ hydrocarbon mono- or diolefins as taught in U.S. Pat. No. 3,769,216 and U.K. Patent No. 1,397,994; a polymer of conjugated diolefin of from 4 to 5 carbon atoms including butadiene, isoprene, 1,3-pentadiene and mixtures thereof as described in U.S. Pat. No. 3,312,621; random copolymers of butadiene and styrene which may be hydrogenated as described in U.S. Pat. Nos. 2,798,853 and 3,554,911; and hydrogenated block copolymers of butadiene and styrene as described in U.S. Pat. No. 3,772,169; and random or block including hydrogenated (partially or fully) copolymers of butadiene and isoprene with up to 25 mol percent of a $C_8$–$C_{20}$ monovinyl aromatic compound, e.g. styrene as described in U.S. Pat. No. 3,795,615, all of which patents are incorporated herein by reference.

Particularly preferred for haze-removal treatment according to this invention are ethylene copolymers of from about 2 to about 98, preferably about 30 to 80, optimally about 38 to 70 wt. % of ethylene and one or more $C_3$ to $C_{30}$ alpha olefins, preferably propylene, which have a degree of crystallinity of less than 25 wt. % as determined by X-ray and differential scanning calorimetry and have a number average molecular weight ($\overline{M}_n$) in the range of about 10,000 to about 500,000 as determined by vapor phase osmometry (VPO) or membrane osmometry. Terpolymers containing ethylene, e.g. ethylene-propylene-ethylidene norbornene are also contemplated to be used herein. The amount of the third monomer (a $C_5$ to $C_{15}$ non-conjugated diolefin) ranges from about 0.5 to 20 mole percent, preferably about 1 to about 7 mole percent, based on the total amount of ethylene and alpha olefin present. Representative of third monomers are one or more of the following: cyclopentadiene, 2-methylene-5-norbornene, a non-conjugated hexadiene, or any other alicyclic or aliphatic non-conjugated diolefin having from 6 to 15 carbon atoms per molecule such as 2-methyl norbornadiene, 2,4-dimethyl-2-octadiene, 3-(2-methyl-1-propene) cyclopentene, etc. These ethylene copolymers and terpolymers may be readily prepared using soluble Ziegler-Natta catalyst compositions which are well known in the art. For recent reviews of the literature and patent art see: "Polyolefin Elastomers Based on Ethylene and Propylene", by F. P. Baldwin and G. VerStrate in Rubber Chem. & Tech. Vol. 45, No. 3, 709–881 (1972) and "Polymer Chemistry of Synthetic Elastomers", edited by Kennedy and Tornqvist, Interscience, N.Y. 1969.

Suitable copolymers may be prepared in either batch or continuous reactor systems. In common with all Ziegler-Natta polymerizations, monomers, solvents and catalyst components are dried and freed from moisture, oxygen or other constituents which are known to be harmful to the activity of the catalyst system. The feed tanks, lines and reactors may be protected by blanketing with an inert dry gas such as purified nitrogen. Chain propagation retarders or stoppers, such as hydrogen and anhydrous hydrogen chloride, may be fed continuously or intermittently to the reactor for the purpose of controlling the molecular weight within the desired limits and the degree of crystallinity known to be optimum for the end product.

Examples of the above-noted alpha monoolefins include propylene, 1-butene, 1-pentene, 1-hexene, 1-heptene, 1-decene, 1-dodecene, etc.

Representative non-limiting examples of non-conjugated diolefins include:

A. Straight chain acyclic dienes such as: 1,4-hexadiene; 1,5-heptadiene, 1,6-octadiene.

B. Branched chain acyclic dienes such as: 5-methyl-1,4-hexadiene; 3,7-dimethyl 1,6-octadiene; 3,7-dimethyl-1,7-octadiene; and the mixed isomers of dihydromyrcene and dihydroocimene.

C. Single ring alicyclic dienes such as: 1,4-cyclo-hexadiene; 1,5-cyclo-octadiene; 1,5-cyclo-dodecadiene; 4-vinylcyclohexene; 1-allyl-4-isopropylidene cyclohexane; 3-alylcyclopentene; 4-allylcyclohexene and 1-isopropenyl-4(4-butenyl) cyclohexane.

D. Multi-single ring alicyclic dienes such as: 4,4'-dicyclopentenyl and 4,4'-dicyclohexenyl dienes.

E. Multi-ring alicyclic fused and bridged ring dienes such as tetrahydroindene; methyl tetrahydroindene; dicyclopentadiene; bicyclo(2,2,1)hepta-2,5-diene; alkenyl, alkylidene, cycloalkenyl and cycloalkylidene norbornenes such as: 5-methylene-2-norbornene; 5-ethylidene-2-norbornene; 5-methylene-6-methyl-2- norornene; 5-methylene-6,6-dimethyl-2-norbornene; 5-propenyl-2-norbornene; 5-(3-cyclopentenyl)-2-norbornene and 5-cyclohexyl-idene-2-norbornene.

In general the preparation of copolymers suitable for the practice of this invention by means of Ziegler-Natta catalysts is known in the prior art, for example, see U.S. Pat. Nos. 2,933,480; 3,000,866; and 3,093,621. The copolymers which are primarily produced for use in elastomeric compositions are characterized by the absence of chain or backbone unsaturation, and when made from non-conjugated dienes contain sites of unsaturation in groups which are pendant to or are in cyclic structures outside the main polymer chain. These unsautrated structures render the polymers particularly resistant to breakdown by atmospheric oxidation or ozone. Ethylene-propylene-non-conjugated diolefin copolymers are known articles of commerce. In fact, various examples of such commercially available copolymers are VISTALON®, elastomeric copolymers of ethylene and propylene alone or with 5-ethylidene, 2-norbornene, marketed by EXXON Chemical Co., New York, N.Y. and Nordel ®, a copolymer of ethylene, propylene and 1,4-hexadiene, marketed by E. I. duPont de Nemours & Co., Wilmington, Delaware.

In general, the catalyst compositions used to prepare these copolymers comprise a principal catalyst consisting of a transition metal compound from Groups IVb, Vb, and VIb of the Periodic Table of the Elements, particularly compounds of titanium and vanadium, and organometallic reducing compounds from Groups IIa, IIB and IIIa, particularly organoaluminum compounds which are designated as cocatalysts. Preferred principal catalysts of vanadium have the general formula $VO_zX_t$ wherein z has a value of 0 or 1 and t has a value of 2 to 4, X is independently selected from the group consisting of halogens having an atomic number equal to or greater than 17, acetylacetonates, haloacetylacetonates, alkoxides and haloalkoxides. Non-limiting examples are: $VOCl_3$; $VO(AcAc)_2$; $VOCl_2(OBu)$; $V(AcAc)_3$; and $VOCl_2(AcAc)$ where Bu is n-butyl or isobutyl and (AcAc) is an acetylacetonate.

Preferred cocatalysts have the general formula $AlR'_mX'_n$ wherein R' is a monovalent hydrocarbon radical selected from the group consisting of $C_1$ to $C_{12}$ alkyl, alkylaryl, arylalkyl and cycloalkyl radicals, X' is a halogen having an atomic number equal to or greater than 17, m is a number from 1 to 3 and the sum of m and n is equal to 3. Non-limiting examples of useful cocatalysts are: $Al(Et)_3$; $Al(IsoBu)_3$; $Et_2AlCl$; $EtAlCl_2$ and $Et_3Al_2Cl_3$.

Syntheses of the copolymers, which may be conducted in batch, staged or continuous reactors, are preferably run in the presence of a purified solvent such as hexane which has been percolated through LINDE 3A catalyst and in the absence of moisture, air or oxygen and catalyst poisons. An atmosphere of oxygen-free nitrogen is preferably maintained above the reactants. Monomers, principal catalyst and cocatalyst are fed to the reactor supplied with means for withdrawing the heat of reaction and maintained under controlled agitation for a time, temperature and pressure sufficient to complete the reaction.

Suitable times of reaction will generally be in the range from 1 to 300 minutes, temperatures will usually be in the range of −40° C. to 100° C., preferably 10 C to 80° C., most preferably 20° C. to 60° C. and pressures from atmospheric to 160 psig are generally used. Monomer feed to the reactor per 100 parts by weight of solvent may be in the range of: ethylene, 2 to 20 parts by weight, $C_3$ to $C_{18}$ -olefin, 4to 20 parts by weight and non-conjugated diene 0.1 to 10 parts by weight.

Principal catalyst, $VOCl_3$ for example, prediluted with solvents is fed to the reactor so as to provide a concentration in the range of 0.1 to 5.0 millimoles per liter. Cocatalyst, for example $Et_3Al_2Cl_3$ is at the same time fed to the reactor in an amount equal to from 2.0 to 20.0 moles of cocatalyst per mole of principal catalyst.

In general, polymers having a narrow range of molecular weight may be obtained by a choice of synthesis conditions such as choice of principal catalyst and cocatalyst combination and addition of hydrogen during the synthesis. Post synthesis treatment such as extrusion at elevated temperature and under high shear through small orifices and fractional precipitation from solution may also be used to obtain narrow ranges of desired molecular weights. For a comprehensive review of the art see: "Polymer Chemistry of Synthetic Elastomers", edited by Kennedy and Tornqvist, Interscience, N.Y. 1969.

Molecular weight may be further regulated by choice of solvent, principal catalyst concentration, temperature, and the nature and amount of the cocatalyst, e.g., aluminum alkyl cocatalyst concentration.

OIL SOLUBLE HYDROCARBYL SUBSTITUTED SUCCINIC ACID

In accordance with the practice of this invention, the hazy oil additive compositions or oil compositions are treated with the oil-soluble hydrocarbyl substituted succinic acid. The hydrocarbyl moiety of the succinic acid may be alkenyl or alkyl. The hydrocarbyl moiety contains at least a sufficiently long carbon chain to render the hydrocarbyl substituted succinic acid oil soluble. Thus, the hydrocarbyl moiety contains at least 10 carbon atoms, preferably at least about 12 carbon atoms, and more preferably at least 12 carbon atoms. Generally, the hydrocarbyl moiety contains less than about 100 carbon atoms, preferably less than about 30 carbon atoms, and more preferably less than about 20 carbon atoms. In a preferred embodiment, the hydrocarbyl substituted succinic acid is a $C_{10}$ to about $C_{20}$, preferably a $C_{12}$ to about $C_{18}$, more preferably a $C_{12}$ to about $C_{16}$, and most preferably a $C_{12}$ hydrocarbyl, preferably alkyl substituted succinic acid. The preferred hydrocarbyl substituted succinic acids may be represented by the general formula

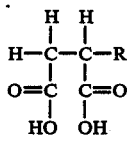

wherein R is a $C_{10}$–$C_{100}$, preferably $C_{12}$–$C_{20}$, more preferably a $C_{12}$–$C_{18}$, and most preferably a $C_{12}$–$C_{16}$ hydrocarbyl, preferably alkyl radical. The alkyl radicals represented by R may be branched or straight chain. However, straight chain alkyl radicals are preferred.

Some illustrative non-limiting examples of the hydrocarbyl substituted succinic acids include decyl succinic acid, dodecyl succinic acid, tridecyl succinic acid, tetradecyl succinic acid, octadecyl succinic acid, and polyisobutenyl succinic acid.

The hydrocarbyl substituted succinic acid haze treating agents of the present invention contain two hydrogen dissociating moieties which have pKs above about 3, preferably above about 4, i.e., a $pK_1$ and a $pK_2$ of at least 3, preferably at least 4. For the purposes of the instant invention the pK can be defined as the negative logarithm to the base 10 of the equilibrium constant for the dissociation of the acid.

HAZE TREATING CONDITIONS

The oil composition such as a lubricating oil concentrate composition containing the hydrocarbon polymer viscosity index improving material normally contains at least a viscosity index improving amount, e.g., from about 0.01 to about 50, preferably from about 1 to about 50, and more preferably from about 2 to about 30, wt. %, based upon the total weight of the oil composition, of the hydrocarbon polymer additive. It has been found that those oil additive compositions which are hazy and can be treated according to the invention contain a hazing agent derived from a dissociable metal containing material such as a metal salt of a weak organic acid. A weak organic acid has an acid moiety having a pK of more than about 3.8 usually a pK of 4 to 8. The hazing agent typically has a particle size of from about 0.01 microns to about 15 microns and is present in a concentration of less than 1 wt. %, more usually less than 0.1 wt. % based on the weight of the composition. The amount of the hazing materials present in the oil compositions is generally dependent upon the amount of ethylene copolymer viscosity index improver which these compositions contain. Generally, however, this amount is less than about 1 wt. % based on the weight of the composition.

These metals which are found to contribute to haze include the alkaline earth metals, zinc, sodium, potassium, aluminum, vanadium, chromium, iron, manganese, cobalt, nickel, cadmium, lead, bismuth and antimony. Such metals which develop the haze can come from a variety of sources during the manufacture of the hydrocarbon polymer such as an ethylene copolymer including the catalyst, impurities developed during mechanical processing of the ethylene copolymer and from dispersants used to maintain the polymer in dispersion or suspension while stored during subsequent processing or awaiting shipping. It is generally possible to filter out those haze contributing particles which have a particle size greater than about 15 microns. At lesser sizes, it has been found that the haze producing impurity is difficult if not impossible to filter so that it is optimally treated according to this invention.

It has been found useful to carry out the process by first treating the hydrocarbon polymer such as ethylene copolymer containing oil composition, e.g., an oil concentrate composition, with the hydrocarbyl substituted succinic acid in an amount effective to reduce or substantially eliminate the haze of said oil compositions and thereafter filtering out the large process debris or insoluble particulate matter. The amount of hydrocarbyl substituted succinic acid which is effective to reduce or substantially eliminate the haze, i.e., a haze reducing or eliminating effective amount, is any amount which is effective to reduce or preferably eliminate the haze of said oil compositions. Generally, this amount is within the range of from about 0.001 to about 10 weight percent, preferably from about 0.01 to about 1 weight percent, and more preferably from about 0.05 to about 0.3 weight percent based upon the total weight of the oil composition solution.

It is to be understood that only one hydrocarbyl substituted succinic acid or a mixture of two or more different hydrocarbyl substituted succinic acids may be used in the practice of the instant invention.

The treatment of the haze containing ethylene copolymer oil composition is carried out at a temperature of from about room temperature to about 250° C., preferably from about 50 to about 160° C., and for a time period of about 0.1 hour up to about 20 hours, preferably from 0.5 to about 2 hours. There is no need to carry out the treatment under pressure. This makes it possible to conduct the process of the invention in an open vessel in the presence of air or inert gas wherein the amount of haze treating agent, i.e., the oil-soluble strong acid is added with stirring. It is useful to blend ethylene copolymer (V.I. improver) solutions containing the anti-hazing amount of oil-soluble hydrocarbyl substituted succinic acid with zinc dialkyldithiophosphate in the presence of a diluent oil for additive concentrate applications. To stabilize the zinc dialkyldithiophosphate systems, e.g. 1 to 10 volume % of zinc di($C_4$–$C_5$ alkanol)dithiophosphate in diluent mineral oil, against hydrolysis, it is necessary to add 0.01 to 0.1 wt. % amine phosphate, such as di-$C_{13}$–Oxo hydrogen acid phosphate neutralized with a diamine, e.g., n-propylstearyl diamine (see U.S. Pat. No. 3,826,745).

The hydrocarbon polymers treated with the hydrocarbyl substituted succinic acid find their primary utility in lubricating oil compositions, particularly lubricating oil concentrate compositions, as viscosity index improver additives. These lubricating oil compositions employ a base oil in which these additives are dissolved. Normally these additives are added to the lubricating oil composition in the form of a lubricating oil concentrate compositions containing a lube oil and from about 0.01 to about 50, preferably from about 1 to about 50, and more preferably from about 2 to about 30 wt. % of said additive and from about 0.001 to about 10, preferably from about 0.01 to about 1, and more preferably from about 0.05 to about 0.3 wt. % of hydrocarbyl substituted succinic acid, and said oil concentrates are then added to an oil composition to form the formulated oil composition, e.g., SAE 10W-40 lube oil composition. These lubricating oil concentrates may also optionally contain other additives as hereinafter described.

The fully formulated lubricating oil compositions normally contain a viscosity index improving amount of the hydrocarbon viscosity index improvers. By viscosity index improving amount is meant any amount which improves the viscosity index of the oil, such as lubricating oil, composition. Generally, this amount is from about 0.01 to 20 wt. %, preferably from 0.1 to about 15 wt. %, based on the weight of said lubricating oil composition, of the viscosity index improvers of the present invention.

Such base oils may be natural or synthetic although the natural base oils will derive a greater benefit.

Thus, base oils suitable for use in preparing lubricating oil concentrates and compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing viscosity index modifier additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols, polyalpha-olefins, alkyl benzenes, organic esters of phosphoric acids, polysilicone oils, etc.

Natural base oils include mineral lubricating oils which may vary widely as to their crude source, e.g., whether paraffinic, naphthenic, mixed, paraffinicnaphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic , naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, molecular sieves, etc.

The lubricating oil base stock conveniently has a viscosity of typically about 2.5 to about 12, and preferably about 2.5 to about 9 cSt. at 100° C.

Thus, the additives of the present invention can be employed in a lubricating oil concentrate composition or fully formulated lubricating oil composition which comprises lubricating oil, typically in a major amount, and (i) the viscosity index improver additive, typically in a minor amount, which is effective to impart improved viscometric properties, relative to the absence of the additive, and (ii) an anti-haze effective amount of the hydrocarbyl substituted succinic acid. Additional conventional additives selected to meet the particular requirements of a selected type of lubricating oil concentrate composition or fully formulated lubricating oil composition can be included as desired.

The additives of this invention, i.e., hydrocarbon polymer and hydrocarbyl substituted succinic acid are oil-soluble, dissolvable in oil with the aid of a suitable solvent , or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed.

Accordingly, while any effective amount of the multifunctional viscosity index improver additives can be incorporated into the lubricating oil composition, it is contemplated that such effective amount be sufficient to provide said lube oil composition with an amount of the additive of typically from about 0.01 to about 20 e.g., 0.1 to 10, and preferably from about 0.1 to about 15 wt. %, based on the weight of said composition.

The lubricating oil base stock for the additives of the present invention typically is adapted to perform a selected function by the incorporation of additives therein to form lubricating oil compositions (i.e., formulations).

Representative additives typically present in such formulations include other viscosity modifiers, corrosion inhibitors, oxidation inhibitors, friction modifiers, dispersants, anti-foaming agents, anti-wear agents, pour point depressants and the like.

Viscosity modifiers impart high and low temperature operability to the lubricating oil and also impart thereto acceptable viscosity or fluidity at low temperatures.

Viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have number average molecular weights of from 10,000 to 50,000, preferably 20,000 to 200,000, e.g., 20,000 to 250,000, as determined by gel permeation chromatography or membrane osmometry.

Representative examples of suitable viscosity modifiers are any of the types known to the art including polyisobutylene, polymethacrylates, methacrylate copolymers, copolymers of an unsaturated dicarboxylic acid and vinyl compound and interpolymers of styrene and acrylic esters.

Corrosion inhibitors, also known as anti-corrosive agents, reduce the degradation of the metallic parts contacted by the lubricating oil composition. Illustrative of corrosion inhibitors are zinc dialkyldithiophosphate, phosphosulfurized hydrocarbon and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at a temperature in the range of 150° to 600° F. Neutralization of the phosphosulfurized hydrocarbon may be effected in the manner taught in U.S. Pat. No. 1,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Patent No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses scarboxyalkylene hydro-carbyl succinimide, Scarboxyalkylene hydrocarbyl succinamic acid and mixtures thereof; U.S. Pat. No. 3,879,306 which discloses N-(hydroxyalkyl)alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis alkanols such as described in U.S. Pat. No. 4,344,853, disclosure of this patent also being herein incorporated by reference.

Dispersants maintain oil insolubles, resulting from oxidation during use, in suspension in the fluid thus preventing sludge flocculation and precipitation or deposition on metal parts.

Pour point depressants lower the temperature at which the fluid will flow or can be poured. Such depressants are well known. Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate, zinc diaryldithiosphate and magnesium sulfonate.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz, overbased) metal salts, such as highly basic alkaline earth metal sulfonates (especially Ca and Mg salts)are frequently used as detergents. Representative examples of such materials, and their methods of preparation, are found in co-pending Ser. No. 754,001, filed July 11, 1985, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Broad Wt. % a.i | Preferred Wt. % a.i |
|---|---|---|
| Viscosity Modifier | .01–20 | .01–15 |
| Corrosion Inhibitor | 0.01–5 | .01–1.5 |
| Oxidation Inhibitor | 0.01–1 | .01–1.5 |
| Dispersant | 0.1–20 | 0.1–8 |
| Pour Point Depressant | 0.01–5 | .01–1.5 |
| Anti-Foam Agents | 0.001–3 | .001–0.15 |
| Anti-Wear Agents | 0.001–5 | .001–1.5 |
| Friction Modifiers | 0.01–5 | .01–1.5 |
| Detergents/Rust Inhibitors | .01–20 | .01–3 |
| Mineral Oil/Base | Balance | Balance |

The following examples illustrate more clearly the present invention. These examples are presented by way of illustration and are not to be interpreted as specific limitations of the invention. In the examples, unless otherwise indicated, all parts and percentages are on a weight basis.

The following example falls outside the scope of the instant invention in that the composition described therein contains no hydrocarbyl substituted succinic acid. This example is presented for comparative purposes only.

EXAMPLE 1

A lubricating oil concentrate is prepared containing about 8 wt. % of an ethylene-propylene copolymer (having an ethylene content of about 45 wt. %, an $\overline{M}_n$ of about 53,000, an $\overline{M}_w$ of about 154,000, and an $\overline{M}_n/\overline{M}_w$ of about 2.9) by dissolving said copolymer in S-100 Neutral mineral oil. This oil concentrate is subjected to visual inspection and is found to be quite hazy.

The following examples illustrate compositions of the instant invention.

EXAMPLE 2

There are added 0.09 gram of an oil solution of dodecyl succinic acid, containing about 70 wt. % of dodecyl succinic acid, to 100 grams of an oil concentrate containing about 8 wt. % of an ethylene-propylene copolymer (having an ethylene content of about 45 wt. %, an $\overline{M}_n$ of about 53,000, an $\overline{M}_w$ of about 154,000, and an $\overline{M}_w/\overline{M}_n$ of about 2.9) dissolved in S-100 Neutral mineral oil. This mixture is heated to 60° C. with stirring and then cooled to room temperature. This oil concentrate is subjected to visual inspection and is found to have significantly less haze than the oil concentrate of Example 1.

EXAMPLE 3

The procedure of Example 2 is substantially repeated except that 0.05 gram of an oil solution of dodecyl succinic acid, containing 7 wt. % of dodcecyl succinic acid, is added to 100 grams of the oil concentrate. The resultant oil concentrate is subjected to visual inspection and is found to have less haze than the oil concentrate of Example 1 but more haze than the oil concentrate of Example 2.

EXAMPLE 4

The procedure of Example 2 is substantially repeated except that 10 grams of an oil solution of dodecyl succinic acid, containing 70 wt. % dodcecyl succinic acid, is added to 100 grams of the oil concentrate. The resultant oil concentrate is subjected to visual inspection and is found to have significantly less haze than the oil concentrate of Example 1, and less haze than the oil concentrates of Examples 2 and 3.

EXAMPLE 5

Approximately 1000 grams of a polyisobutenyl succinic acid is prepared by hydrolyzing 500 grams of polyisobutenyl succinic anhydride (initially having an active ingredient level of 90 to 95%, a saponification number 112, and a polyisobutene $\overline{M}_n$ of about 950) diluted with 500 grams S-100 Neutral oil and about 27 grams of water at 95.C. The reaction is monitored by infra-red spectra until no change is noted. The reaction product is cooled and vacuum stripped at 70° C. with a slight nitrogen purge for two hours and then cooled to room temperature. One gram of the above solution of polyisobutenyl succinic acid (containing about 45 wt. % polyisobutenyl succinic acid) is added to 99 grams of the oil concentrate of Example 1. The resulting mixture is heated to 60° C. with stirring and then cooled to room temperature. This oil concentrate is subjected to visual inspection and is found to have less haze than the oil concentrate of Example 1.

In summary, the preceding examples, which teach the product and process of the invention, have demonstrated that haze reduction of ethylene copolymer viscosity index improver containing oil compositions is readily realized when such compositions are treated according to the process of this invention. Not only is the haze reduced but these compositions remain visually improved in haze reduction for periods of time usually met in the shelf life required for such oil compositions.

As earlier noted the oil additive concentrate or compositions are contemplated to be admixed with other additives such as zinc dihydrocarbyl dithiophosphate, and other conventional additives may also optionally be present including dyes, pour point depressants, antiwear agents such as tricresyl phosphate as well as the above-mentioned zinc compound, antioxidants such as N-phenyl, alpha-naphthyl amine, tertoctylphenol sulfide, 4,4'-methylene bis(2,6-ditert-butylphenol), other viscosity index improvers such as polymethacrylates, alkyl fumarate-vinyl acetate copolymers and the like as well as ashless dispersants, detergents, etc.

What is claimed is:

1. A process of reducing haze in a composition comprising (i) lubricating oil;

(ii) at least a viscosity index improving amount of viscosity index improver comprising a hydrocarbon polymer; and (iii) a haze forming amount of an oil insoluble haze forming material resulting from the manufacture or finishing processes of said hydrocarbon polymer;

which process comprises adding to said composition a hazereducing effective amount of at least one hydrocarbyl substituted succinic acid.

2. The process of claim 1 which comprises treating said composition with said hydrocarbyl substituted succinic acid to thereby decrease haze.

3. The process of claim 2 which comprises treating said composition with hydrocarbyl substituted succinic acid at a temperature of from room temperature to about 250° C. for a period of from about 0.1 to about 20 hours.

4. The process of claim 1 wherein said hydrocarbon polymer has a number average molecular weight of from about 10,000 to about 500,000.

5. The process of claim 4 wherein said hydrocarbon polymer comprises a copolymer of ethylene and at least one $C_3$ to $C_{30}$ alpha-olefin.

6. The process of claim 5 wherein said ethylene copolymer contains from about 2 to about 98 wt. % ethylene and from about 98 to about 2 wt. % of at least one $C_3$ to $C_{30}$ alpha-olefin.

7. The process of claim 6 wherein said alpha-olefin is propylene.

8. The process of claim 7 wherein said copolymer is ethylene-propylene copolymer containing from about 30 to about 80 wt. % ethylene and from about 20 to about 70 wt. % propylene.

9. The process of claim 1 wherein said hydrocarbyl substituted succinic acid is a $C_{10}$ to about $C_{50}$ hydrocarbyl substituted succinic acid.

10. The process of claim 9 wherein said hydrocarbyl substituted succinic acid is a $C_{12}$ to about $C_{20}$ hydrocarbyl substituted succinic acid.

11. The process of claim 10 wherein said hydrocarbyl substituted succinic acid is a $C_{12}$ to about $C_{18}$ hydrocarbyl substituted succinic acid.

12. The process of claim 11 wherein said $C_{12}$ to about $C_{18}$ hydrocarbyl is a $C_{12}$ to about $C_{18}$ alkyl.

13. The process of claim 11 wherein said $C_{12}$ to about $C_{18}$ substituted succinic hydrocarbyl acid is $C_{12}$ to about $C_{16}$ hydrocarbyl substituted succinic acid.

14. The process of claim 13 wherein said $C_{12}$ to about $C_{16}$ hydrocarbyl is $C_{12}$ to about $C_{16}$ alkyl.

15. The process of claim 14 wherein said $C_{12}$ to about $C_{16}$ alkyl substituted succinic acid is dodecyl succinic acid.

16. The process of claim 1 which comprises adding from about 0.001 to about 10 weight percent, based on the weight of said composition of said hydrocarbyl substituted succinic acid.

17. The process of claim 16 which comprises adding from about 0.01 to about 1 weight percent of said hydrocarbyl substituted succinic acid.

18. The process according to claim 1 wherein said composition is an oil concentrate.

19. The process according to claim 18 wherein said concentrate contains from about 0.01 to 50 weight percent of said hydrocarbon polymer.

20. The process according to claim 19 wherein acid concentrate contains from about 1 to about 50 weight percent of said hydrocarbon polymer 21. A composition comprising:

(i) lubricating oil;

(ii) viscosity index improver comprising a hydrocarbon polymer;

(iii) haze forming amount of an oil insoluble haze forming material resulting from the manufacture or finishing processes of said hydrocarbon polymer; and (iv) a haze reducing effective amount of hydrocarbyl substituted succinic acid.

22. The composition of claim 21 which contains at least a viscosity index improving amount of said hydrocarbon polymer.

23. The composition of claim 22 wherein said hydrocarbon polymer has a number average molecular weight of from about 10,000 to about 500,000.

24. The composition of claim 23 wherein said hydrocarbon polymer comprises a copolymer of ethylene and at least one $C_3$ to $C_{30}$ alpha-olefin.

25. The composition of claim 24 wherein said copolymer contains from about 2 to about 98 wt. % ethylene and from about 98 to about 2 wt. % of at least one $C_3$ to $C_{30}$ alpha-olefin.

26. The composition of claim 25 wherein said alpha-olefin is propylene.

27. The composition of claim 26 wherein said copolymer is ethylene-propylene copolymer containing from about 30 to about 80 wt. % ethylene and from about 20 to about 70 wt. % propylene.

28. The composition of claim 21 wherein said hydrocarbyl substituted succinic acid is a $C_{10}$ to about $C_{100}$ hydrocarbyl substituted succinic acid.

29. The composition of claim 28 wherein said hydrocarbyl substituted succinic acid is a $C_{12}$ to about $C_{20}$ hydrocarbyl substituted succinic acid.

30. The composition of claim 21 wherein said hydrocarbyl substituted succinic acid is a $C_{12}$ to about $C_{18}$ hydrocarbyl substituted succinic acid.

31. The composition of claim 30 wherein said $C_{12}$ to about $C_{18}$ hydrocarbyl is a $C_{12}$ to about $C_{18}$ alkyl.

32. The composition of claim 31 wherein said $C_{12}$ to about $C_{18}$ substituted succinic acid is a $C_{12}$ to about $C_{16}$ hydrocarbyl substituted succinic acid.

33. The composition of claim 32 wherein said $C_{12}$ to about $C_{16}$ hydrocarbyl is $C_{12}$ to about $C_{16}$ alkyl.

34. The composition of claim 33 wherein said $C_{12}$ to about $C_{16}$ alkyl substituted succinic acid is dodecyl succinic acid.

35. The composition of claim 21 which contains from about 0.001 to about 10 weight percent, based on the weight of said composition, of said hydrocarbyl substituted succinic acid.

36. The composition of claim 35 which contains from about 0.01 to about 1 weight percent of said hydrocarbyl substituted succinic acid.

37. The composition of claim 35 which is an oil concentrate.

38. The composition of claim 37 which contains from about 1 to about 50 weight percent of said hydrocarbon polymer.

39. The composition of claim 38 which contains from about 2 to about 30 weight percent of said hydrocarbon polymer.

* * * * *